United States Patent [19]

Fitzgerald

[11] 4,385,257

[45] May 24, 1983

[54] LAMP BASE

[75] Inventor: James J. Fitzgerald, Kinnelon, N.J.

[73] Assignee: Edison International, Inc., Rolling Meadows, Ill.

[21] Appl. No.: 209,907

[22] Filed: Nov. 24, 1980

[51] Int. Cl.[3] ..... H01J 5/48; H01J 5/50

[52] U.S. Cl. ..... 313/318; 313/113; 313/315; 339/74 L; 339/59 L; 339/176 L; 362/226; 362/267

[58] Field of Search ..... 313/318, 315, 113; 339/74 L, 59 L, 154 L, 144 R, 145 R; 362/267, 226, 306, 310

[56] References Cited

U.S. PATENT DOCUMENTS

| | | | |
|---|---|---|---|
| 1,027,306 | 2/1911 | Avery | 362/267 |
| 2,398,971 | 4/1946 | Singer | 362/267 |
| 2,757,275 | 7/1956 | Lehr | 362/267 X |
| 3,089,951 | 5/1963 | Baldwin | 362/267 |
| 3,511,982 | 5/1970 | Salter | 362/226 |
| 3,997,808 | 12/1976 | Wojtowicz | 339/145 R |
| 4,061,940 | 12/1977 | Fitzgerald et al. | 313/318 |
| 4,152,622 | 5/1979 | Fitzgerald | 313/318 |
| 4,287,448 | 9/1981 | Bradley | 313/318 |

*Primary Examiner*—Saxfield Chatmon, Jr.
*Attorney, Agent, or Firm*—Jon Carl Gealow; James A. Gabala; Charles W. MacKinnon

[57] ABSTRACT

The invention relates to a base for a cartridge lamp of the type having at least one filament mounted on filament support legs extending through a seal of the bulb. According to the invention, a plug member has terminals affixed thereto for mounting the filament support legs. The plug member is adapted for keyed insertion into an opening. The terminals extend beyond the plug surface to form tangs which act as clamping fingers. The tangs also serve for contacting the connecting leads after the plug member has been rotated into a locking position.

9 Claims, 4 Drawing Figures

LAMP BASE

BACKGROUND OF THE INVENTION

The invention relates to a base for a cartridge lamp of the type having at least one filament mounted on filament support legs extending through a seal of the bulb for external mounting on electrically-conducting terminals.

Typically, conventional lamps have consisted of at least one filament enclosed in a bulb which bulb is then glued or otherwise affixed in a known manner to an electrically conducting lamp base to form an integral unit for installation in a conventional socket. When sealed to the bulb, the lamp base was found, in many cases, to be inaccurately aligned with respect to the filament so that in critical applications when the base is inserted into the socket, as for instance, by screwing a threaded base into a threaded socket, the filament within the bulb was not properly positioned.

An attempt to overcome this misalignment problem is disclosed in the invention of a baseless cartridge lamp U.S. Pat. No. 4,061,940, incorporated herein by reference. The cartridge lamp comprises at least one filament mounted on filament support legs carried through and sealed into the bulb. The support legs provide means for external electrical connection and mechanical mounting on supporting terminals.

Also disclosed in that patent is a socket for holding a lamp of this design. The socket disclosed therein, however, holds the lamp filament generally parallel to the longitudinal axis of the base of the socket which is not a very practical arrangement for use with a reflector. The prior art lamps utilizing an integral base are also limited in that the base requires a great deal of space external to the reflector assembly.

In many cases, when these reflector assemblies are installed on motor vehicles and the like, there exists much less room for the removal and replacement of these lamps than would be desirable for maintain-ability standards. Additionally, in a great number of cases, the only way that a lamp can be replaced is through the removal of the entire lamp-reflector assembly.

SUMMARY OF THE INVENTION

A baseless lamp of the type disclosed in U.S. Pat. No. 4,061,940, or any similar lamp having different filament and/or filament support configurations that extend out through the seal of the bulb, is mounted on and electrically connected to terminals of rigid metal which are affixed at the surface of a plug member.

A plug member according to the invention is adapted for keyed insertion into an opening, in for example, a reflector assembly. The invention also contemplates insertion into other holding member, particularly the lens of a reflector-lens combination. The plug member is of circular cross section and has an annular shoulder for abutment with a corresponding shoulder of this opening.

The terminal portions along the surface of the plug member are extended beyond the top portion of the plug member to form tangs. The tangs are adapted to press against the inner surface of the reflector as clamping fingers to grasp the reflector assembly between the shoulder and the tangs to secure the plug in the opening. A boss on the plug allows the base to be rotated only to the point where the lamp is secured and in proper alignment. The tangs may take any convenient form so that they may be adapted upon the rotations of the plug member to be in contact with lead wires, spade terminals, or other conventional terminal devices for electrically contacting other mating terminals.

The base according to the invention, therefore, allows a flush mounting with the rear of a reflector. Additionally, it enables axial mounting of the lamp with respect to the central axis of the reflector through the opening in the reflector. Of course, the base is not limited to insertion in the rear of a reflector assembly and the plug itself may be inserted in any location where an opening in a wall of corresponding dimensions may be positioned.

When the base according to the invention is installed in the lens of a reflector-lens assembly, the plug material may be transparent or translucent to match the material of the lens.

When the plug itself is transparent, the transparency of the plug allows illumination from the bottom of the lamp to be emitted through the base. The base having the cartridge lamp in place is inserted into a corresponding opening in the lens as previously described. The cooperation of the annular shoulder and the terminal tangs as clamping fingers holds the base in the lens so that the lamp is aligned in proper axial position with respect to the reflector.

Electrical contact to the tangs of the terminals may be made through wire ribbons carried on the lens itself. The wire ribbons are extended to conventional terminal assemblies external to the reflector. Of course, electrical contact may be made by any of the other means well known in the art.

Further features and objects of the invention will be made clear from the description of the drawings.

FIG. 2(*a*) illustrates one form of keyed opening for securing the lamp base of the present invention to a mount.

Figure 1:
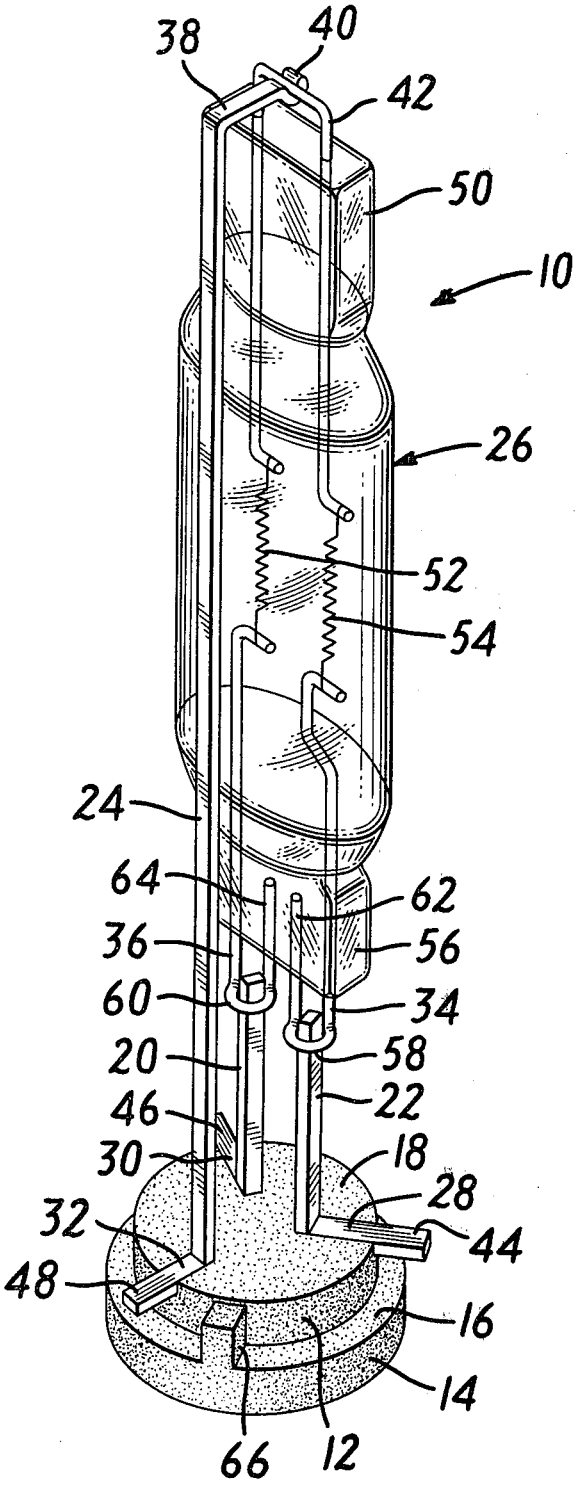
FIG. 1 is a perspective view of the lamp base, incorporating a cartridge lamp.

Referring now to FIG. 1, a lamp base according to the invention having a two-filament cartridge lamp mounted thereon is shown generally at 10. An insulating molded plug 12, preferably of polycarbonate material, is a disc of circular cross section having an annular flange 14 around a lower portion of its perimeter which forms a shoulder 16. As shown in FIG. 1, the upper surface 18 carries three terminals 20, 22, 24 for attachment of a baseless cartridge lamp indicated generally by the numeral 26.

Each of the terminals 20, 22, 24 comprise a rigid wire member having a segment 28, 30, and 32 affixed respectively on the surface of the disc 12 and another segment at right angles to the surface of disc 12 extending upward from and parallel to the axis of disc 12. Two of the terminals 20, 22 extend only a short distance and are adapted to engage lower filament support legs 34, 36 of the cartridge lamp 26, preferably in a manner described below.

A third terminal 24 extends in substantially the same direction as the terminals 20, 22 and to a predetermined distance corresponding to the dimensions of lamp 26.

This third terminal 24 ends in a right angle bend 38 having a hook 40 at the end adapted to engage the filament support loop 42 of the cartridge lamp 26 preferably in a manner described below. It is clear that for a single filament lamp such a third terminal 24 would be unnecessary and the single filament lamp would be mounted only on the two terminals 20, 22.

A portion of each segment 28, 30, and 32 extends beyond the periphery of the upper portion of the disc 12, preferably at least as far as the outer periphery of the flange 14 to form tangs 44, 46, and 48 respectively.

The terminals may be composed of any conventional rigid electrically conducting material, but preferably they are made of cadmium-coated steel. The terminals may be affixed to the surface 18 by any conventional means for attaching metal to a polycarbonate plastic such as, for instance, by epoxy bonding thereof. Preferably, however, the terminals are mounted by fusing the polycarbonate plastic with the portions of the terminals 28, 30, and 32 imbedded therein.

As shown in FIG. 1 and more fully disclosed in U.S. Pat. No. 4,061,940, the lamp 26 may have an upper U-shaped filament support loop 42 extending from an upper press seal 50 of the bulb as both a filament support and a common electrical terminal for two filaments 52 and 54. Through a second press seal 56 at the base of the lamp 26 extend the two filament support legs 34 and 36. These filament support legs are bent to form hairpin loops 58 and 60. The ends of the support legs 62 and 64 are sealed into the press seal 56 along with the outward extending portions. The ends of the hairpin loops 58 and 60 are further bent to be at substantially right angles to the portions of the filament support legs within the press seal 52.

As shown in FIG. 1, the two hairpin loops 58 and 60 at right angles to terminals 20 and 22 are adapted to conveniently slide onto the two terminal segments 20 and 22. The U-shaped filament support loop 42 at the top of the lamp is engaged by the third terminal 24 by the hook 40 thereon. For installation, the U-shaped filament support 42 is inserted into the hook 40 which is crimped to provide mechanical and electrical attachment thereto. The lamp 26 is then positioned along the terminals 22 and 24 at a predetermined distance from the base plug 12. The hairpin loops 58 and 60 are then crimped to secure the cartridge lamp 26 at this location. Other methods of attachment are also contemplated. For instance, the filament support loops 42 and support legs 34 and 36 may be attached to the respective terminals 22, 20 and 24 by soldering or by spot-welding.

A projection 66 from the disc 12 above flange 14, serves as a registration stop for preventing rotation beyond a predetermined point so that the lamp on its base may be positioned accurately. Any of the conventional means for keying a plug in a corresponding hole are contemplated and the base is not limited to the use of a single projection shown as an example herein.

Figure 2A:
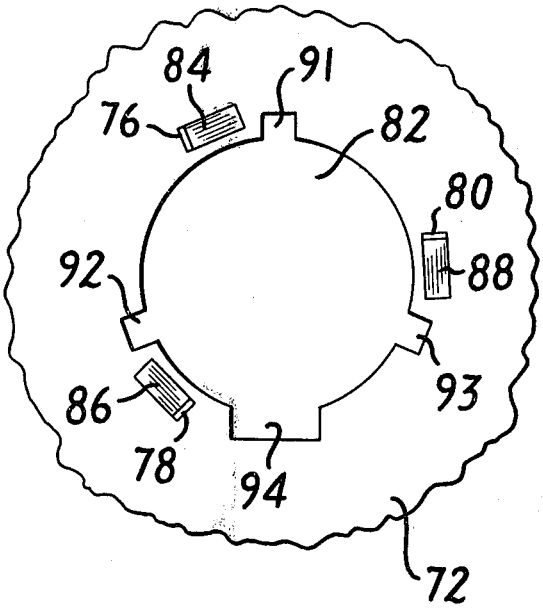
FIG. 2 is a side view of a two-filament cartridge lamp mounted in an embodiment of the base installed in a reflector assembly.
Figure 2:
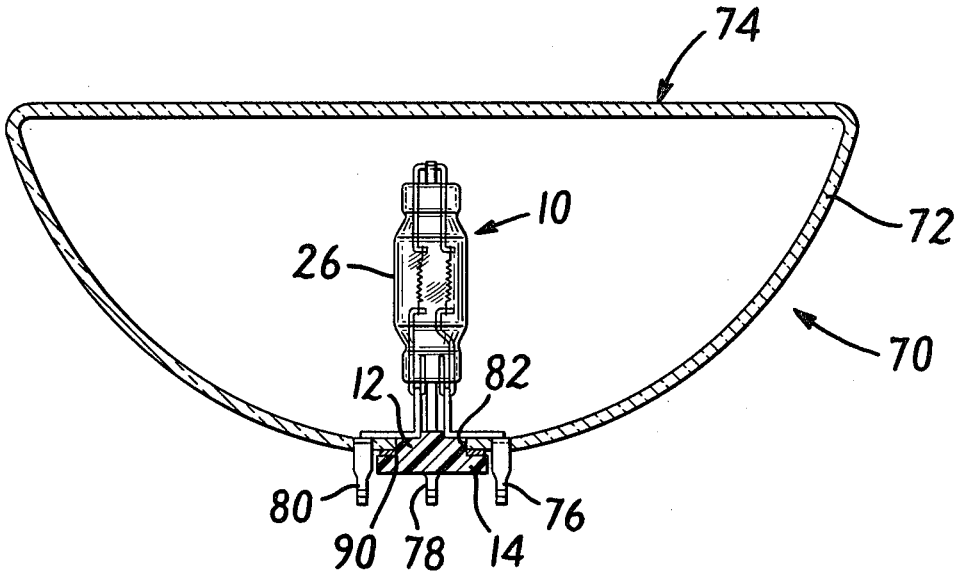

In FIG. 2, a reflector assembly having a two-filament baseless lamp in a socket according to the invention is shown generally at 70. A reflector body 72, which may be made of glass, is affixed in known manner to a lens 74. Of course, the lens 74 and reflector body 72 may alternatively comprise a continuous piece of material such as glass.

Three conventional terminal legs 76, 78, 80 are molded into the reflector body 72 at conventional or standard locations. The reflector body also has a keyed central opening 82 at the bottom adapted to receive the base 12.

Conducting leads 84, 86 and 88, preferably plated into the reflector body, lead from the terminals to end at predetermined points near the opening for supplying electrical current to the tangs 44, 46, and 48, of the lamp base.

A flexible annular seal 90, preferably of neoprene, is positioned surrounding the plug member 12 in abutment with the flange 14. Projection 66 is notched to allow a snug fit of annular seal 90 around the plug 12. Alternatively, annular seal 90 may be notched to snugly abut projection 66.

The base lamp assembly 10 is inserted through the opening 82 until the annular seal 90 is compressed and then the plug member is rotated until such point that the tangs 44, 46, and 48 contact the leads 84, 86 and 88. The clamping occasional by the tangs and the compression of the flexible seal 90 serves to secure the lamp and base assembly 10 within the reflector assembly 70.

One form of a keyed central opening in the base of reflector 72 is illustrated in FIG. 2(*a*). As there shown, the conducting leads 84, 86 and 88 are positioned on the interior surface of the reflector adjacent the keyholes 91, 92 and 93. Tangs 44, 46 and 48 are inserted through the respective keyholes 91, 92 and 93. Tangs 44, 46, and 48 are inserted through the respective keyholes and brought into contact with the conducting leads by rotating the base of the lamp assembly. Proper registration of the tangs in the reflector base is achieved by the lamp base projection 66 which is received in keyhole slot 94 of the reflector. The same keyed central opening may be used for supporting the plug member of the present invention in the modified form of structure illustrated in FIG. 3.

Figure 3:
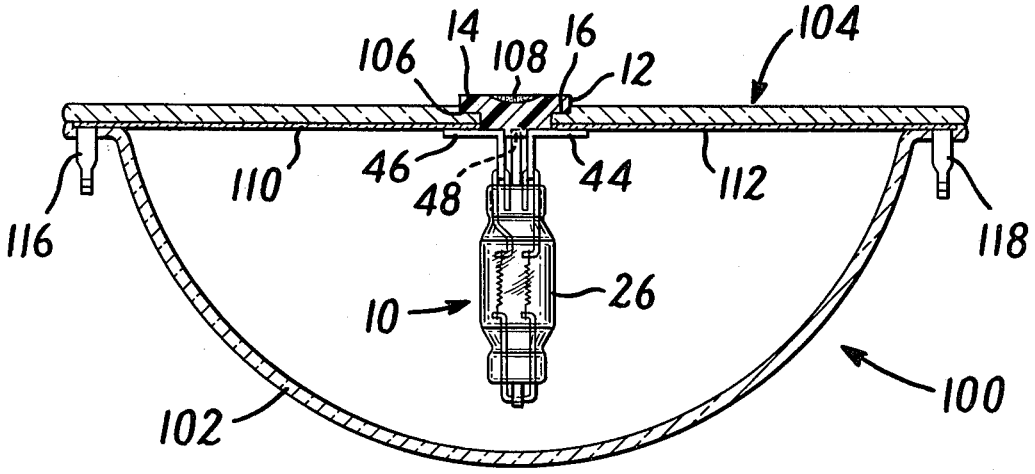
FIG. 3 shows a two-filament cartridge lamp mounted on a base according to the invention, with the base held in a lens of a reflector assembly.

FIG. 3 is a reflector lamp assembly in which the lamp is installed in the transparent or translucent material of the lens so that the lamp may be easily replaced without removing the reflector assembly and without access to the rear of the reflector being required. A lens-reflector-lamp assembly according to the invention, is shown generally at 100. A reflector 102, which may be molded from a glass or plastic piece of material is affixed to a lens 104. The lens may be transparent, however, it may also be translucent as is well known for dome-lighting or other applications, where diffused light is required.

The base, as described in FIG. 1, is inserted in a corresponding keyed hole in the lens. Upon insertion, the shoulder 16 abuts a recess 106 in the lens 104. A screwdriver slot 108 may be included to enable rotation of the plug member in the lens. The rotation brings the tangs 44, 46, and 48 of the terminals into abutment with the interior surface of the lens so as to provide a tight fit of the lens material between the shoulder 16 and the tangs 44, 46, and 48. The arrangement of the keyholes in the perimeter of recess 106 of the lens may be the same as illustrated in FIG. 2(*a*) for reflector 72 and a slot such as slot 94 in reflector 72 is also provided in the lens, which slot in cooperation with stop 66 provides for proper alignment of the lamp.

In the locked position tangs 44, 46 and 48 are in electrical contact with conducting ribbons 110, 112, and 114 positioned on the interior surface of the lens. The ribbons 110, 112 and 114 are preferably transparent. The conducting ribbons 110, 112, and 114 are carried through the junction of the reflector and lens to conventional terminals 116, 118, and 120 located on the exterior of the reflector-lens assembly 100. Two of the conducting ribbons 110 and 112 with corresponding terminals 116 and 118 are illustrated in FIG. 3. Positioning of the third conducting ribbon 114 and terminal 120 will be obvious to those of skill in the art and it is not deemed necessary to show the third ribbon and its corresponding terminal in the drawings.

It is thus clear that a significant improvement in accessibility is obtained by the instant invention. For instance, the external terminals can be self-locking, snap-in plate terminals or they may also be terminal lugs so that electric contact is easily accessible from the front of the reflector-lens assembly.

Of course, the invention is not limited to a two-filament lamp. A single-filament lamp may also be used in place of the 2-filament lamp shown installed in the lens-reflector assemblies, illustrated in the figures.

It will be understood that the claims are intended to cover all changes and modifications of the preferred embodiments of the invention herein chosen for the purpose of illustration which do not constitute departures from the spirit and scope of the invention.

What is claimed is:

1. A lamp base for securing a baseless cartridge lamp having at least two filament support legs, on a lamp housing surface defining a aperture therein about which are provided electrical contact means, said lamp base comprising:

(a) a plug member;

(b) said plug member being of substantially circular cross-section and having an upper surface and an annular flange spaced from said upper surface on a lower portion of said plug member;

(c) at least two terminal members affixed on said upper surface of said plug member, a first portion of each said terminal member extending perpendicular to said upper surface for attachment to said lamp filament support legs; and (d) each said terminal member having a second portion thereof extending from said upper surface radially beyond the periphery of said upper surface to form a clamping means between itself and said annular flange for securing said lamp base on said housing surface in said aperture defined therein, with said second terminal means portion engaging said electrical contact means.

2. A base according to claim 1 further comprising a third terminal extending perpendicular to said first surface a distance greater than the extension of said two terminal members.

3. A lamp base for a baseless cartridge lamp having a filament including a filament support loop, said lamp base comprising:

(a) a plug member;

(b) said plug member being of substantially circular cross-section and having an upper surface and an annular flange spaced from said upper surface on a lower portion thereof;

(c) at least two terminal members affixed at said upper surface of said plug member, a portion of each said terminal member extending perpendicular to said upper surface;

(d) each said terminal member having a portion thereof extending radially beyond the periphery of said upper surface to form a clamping finger between itself and said annular flange; and (e) a third terminal member extending perpendicular to said upper surface a distance greater than the extension of said two terminal members, said third terminal member further comprising a hook at the end thereof, said hook being adapted for engaging said filament support loop of said cartridge lamp.

4. The base according to claim 3 further comprising a two-filament cartridge lamp having a filament support loop for engaging said hook and two filament support legs at an opposite end thereof for engaging said two terminals, all respectively.

5. A baseless cartridge lamp and base therefor comprising:

(a) a cartridge lamp;

(b) said cartridge lamp having a filament support loop at one end thereof and two filament support legs at the other end thereof;

(c) a plug member having an upper surface;

(d) two terminals carried by said plug member, one end portion of each of said terminals extending from said plug member a first distance generally perpendicular to said surface;

(e) a third terminal carried by said plug member, one end portion of said third terminal extending a second distance generally perpendicular to said surface;

(f) said second distance corresponding to the distance between said filament support loop and said filament support legs;

(g) the end of said third terminal engaging said filament support loop and said two terminals engaging said filament support legs for suspending said cartridge lamp therebetween; and (h) each of said terminals having a second end portion extending beyond the periphery of said plug in a direction generally perpendicular to said one end portion of said terminals.

6. The base according to claim 5 wherein the plug has a flange at a lower portion thereof for cooperating engagement of a mounting between said flange and projecting portions of said terminals.

7. A vehicle lamp assembly comprising:

(a) a reflector body having a surface;

(b) a baseless cartridge lamp having a filament mounted therein and at least a pair of filament support legs extending from said lamp;

(c) a base comprising:

(i) a plug member having an upper surface and a flange member spaced predeterminedly from said upper surface on a lower portion of said plug member;

(ii) at least two terminal members mounted on said plug member, first ends of said terminal members extending perpendicular to said upper surface of said plug member, said first ends of said terminal members for mechanical support of and electrical connection to said filament support legs;

(iii) second ends of said terminal members extending outwardly from said plug member a predetermined distance beyond the periphery of said upper surface;

(d) an opening defined in said reflector surface, the cross section of said opening corresponding to the cross section of said plug member for receipt of said plug member therein;

(e) electrical terminals mounted on said reflector;

(f) means for electrically connecting said electrical terminals to a point near the area surrounding said opening; and (g) said flange member and said second ends of said terminal members being disposed on opposite sides of said reflector surface upon insertion of said plug member into said opening to grasp said reflection surface therebetween to secure said lamp base to said reflector body.

8. The reflector lamp assembly of claim 7 further comprising a lens mounted on said reflector.

9. A vehicle headlamp assembly comprising:

(a) a curved reflector with a lens affixed at the open end thereof defining an enclosed headlamp housing;

(b) one of said reflector and lens defining an aperture therein;

(c) a plurality of spaced contacts within said headlamp housing positioned adjacent said aperture;

(d) a lamp base plug member releasably secured in said aperture;

(e) said plug member having a plurality of terminal means mounted thereon and positioned within said headlamp housing, said plug member having an outer surface and a flange portion spaced predeterminedly therefrom, said plurality of terminal means affixed to said outer surface with first ends extending generally perpendicular to said surface into said headlamp housing and second ends extending outwardly from said plug member along said outer surface a predetermined distance beyond the periphery of said outer surface, said flange portion and said second ends of said terminal means being disposed on opposite sides of said one of said reflector and lens, to grasp the surface thereof between said flange portion and second ends of said terminal means to secure said plug members to said headlamp housing; and (f) a cartridge lamp mounted within said headlamp housing having exposed contacts at opposite ends thereof;

(g) said second ends of said terminal means being electrically connected to said spaced contacts adjacent said aperture and said first ends of said terminal means being electrically connected to said lamp contacts and supporting said lamp, whereby the lamp is positioned for illumination within said headlamp housing.

* * * * *